US007559283B2

(12) United States Patent
Clark

(10) Patent No.: US 7,559,283 B2
(45) Date of Patent: Jul. 14, 2009

(54) RAIL CAR DOOR CLOSER

(76) Inventor: Melvin Gary Clark, 738 FM 1283, Pipecreek, TX (US) 78063

( * ) Notice: Subject to any disclaimer, the term of this patent is extended or adjusted under 35 U.S.C. 154(b) by 104 days.

(21) Appl. No.: 11/708,671

(22) Filed: Feb. 20, 2007

(65) Prior Publication Data

US 2007/0193472 A1 Aug. 23, 2007

Related U.S. Application Data

(63) Continuation-in-part of application No. 10/977,337, filed on Oct. 28, 2004, now Pat. No. 7,178,464.

(60) Provisional application No. 60/515,063, filed on Oct. 28, 2003.

(51) Int. Cl.
*B61D 7/00* (2006.01)

(52) U.S. Cl. ..... 105/241.2; 105/288; 105/290; 105/289

(58) Field of Classification Search ..... 105/247, 105/248, 240, 284, 286, 287, 288, 289, 290; 414/372, 376, 377, 378
See application file for complete search history.

(56) References Cited

U.S. PATENT DOCUMENTS 4,829,908 A 5/1989 Hallum
5,249,531 A 10/1993 Taylor
5,299,508 A 4/1994 Connelly
5,302,072 A 4/1994 Stauffer et al.
5,359,942 A 11/1994 Ward
5,419,262 A 5/1995 Turpin, Sr.
5,601,032 A 2/1997 Kosch
6,431,084 B1 8/2002 Gaydos
7,178,464 B2 * 2/2007 Clark ..... 105/241.2

* cited by examiner

*Primary Examiner*—Mark T Le
(74) *Attorney, Agent, or Firm*—Kammer Browning PLLC

(57) ABSTRACT

A track mounted system for closing rail car doors that enables the simultaneous closing of multiple car doors. After hopper car contents such as aggregate or coal are unloaded, the doors are closed in pairs by semi-automated door closing arms that are positioned on the track and are operated by hydraulic cylinders, pneumatic cylinders, or electric motors. The closing arms may be added in pairs depending on the number of doors. Hydraulic cylinders with a differential bell crank can be used to activate the closer arm assemblies. Closer arms can be mounted side by side on the inside or outside of the track or separately inside and outside of the track. Automatic slack adjustment assemblies may be integrated into the closer arm connections to allow for off set door spacing. Individual hydraulic cylinders may be used with each closer arm in an alternate embodiment.

11 Claims, 12 Drawing Sheets

RAIL CAR DOOR CLOSER

CROSS REFERENCE TO CORRESPONDING APPLICATIONS

This application is a Continuation-in-Part of U.S. patent application Ser. No. 10/977,337, filed Oct. 28, 2004 now U.S. Pat, No. 7,178,464, which claims the benefit under Title 35 United States Code §119(e) of U.S. Provisional Application No. 60/515,063 filed Oct. 28, 2003.

BACKGROUND OF THE INVENTION

1. Field of the Invention

The present invention pertains generally to rail car door closures. More specifically, the present invention relates to a system of paired rail door closing arm assemblies that enable the simultaneous closing of multiple rail car hopper doors.

2. Description of the Related Art

The present invention relates to an apparatus for the closure of rail car doors, specifically, the discharge doors of a coal or aggregate hopper car. These doors are extremely heavy and when open, extend vertically downward on hinges from the car frame. When closed, the doors are latched to the car frame and thus secured to prevent opening. When an aggregate or coal car reaches a delivery site, the doors are opened and the contents of the car emptied into receiving areas below the tracks. The car doors must be closed, of course, prior to departure from the site and reloading. The doors are extremely difficult to close manually and such an undertaking is very dangerous to the workers involved in such an operation. Severe injuries may result if a car door fails to latch, swings back open, and strikes a worker.

Various efforts have been made in the past to provide a mechanized system to close these rail car hopper doors. A solution to this problem is not simple as the delivery logistics, track and car configurations, and car door weight pose several challenges. Various rail car door closure devices have been designed to attempt to solve these problems. Examples of automated or partially automated approaches can be found in the following patent disclosures.

U.S. Pat. No. 5,299,508 issued to Connelly on Apr. 5, 1994 entitled RAILROAD CAR DOOR CLOSURE HAVING TRACKSIDE MOUNTED PLURAL ACTUATING ARMS describes a closer apparatus having two closer assemblies. The assemblies are mounted adjacent to each rail of a track on a frame that passes below and between the rails. Each assembly includes a hydraulic closer jack, a hydraulic lifting jack and a hydraulic swing motor for orienting the closer jack relative to a door. The jack is extendable to contact a door and push it to a closed position. The jack assemblies can be pivoted 180 degrees by the swing motor to close the forward door of the hopper and then the rearward door, without having to reposition the train.

U.S. Pat. No. 5,419,262 issued to Turpin Sr. on May 30, 1995 entitled RAILROAD HOPPER CAR DOOR CLOSER discloses a closer for hopper car doors including a supporting frame structure associated with the rails on which a series of hopper cars are positioned together with power actuated devices that pivot the hopper car doors from a generally closed position to a downwardly extending open position and thereafter pivot them about their supporting hinge back to a closed, latched position. The power devices include transversely extending support shafts with a pair of laterally extending rigid arms with each arm including a wheel at its outer end for engaging the hopper car doors when the transverse shafts are pivoted. The transverse shafts are pivoted by hydraulically operated piston and cylinder assemblies connected to a laterally extending arm on one end of each shaft. Activation devices are positioned in the path of movement of the hopper cars to activate the closer when the hopper car doors are in appropriate position for engagement.

U.S. Pat. No. 5,249,531 issued to Taylor on Oct. 5, 1993 entitled RAILROAD HOPPER CAR DOOR ACTUATING MECHANISM discloses an actuating system for operating the doors of a railroad hopper car. A plurality of levers for each hopper operate to rotate the doors of the hopper between an open and a closed position. The mechanism applies a tension force, rather than a compressive force, to push the doors closed. The mechanism also provides an over center latch to positively close each door. The mechanism may be used on either single or double hopper doors.

U.S. Pat. No. 5,302,072 issued to Stauffer et al. on Apr. 12, 1994 entitled TRACK SIDE DOOR CLOSING DEVICE FOR RAILWAY HOPPER CARS discloses a track side device for closing hopper doors which has an eccentrically rotatable wheel. The wheel rotates and contacts a hopper door to move it inward to a closed position. In a preferred embodiment, two devices are positioned on opposite sides of a railroad track to simultaneously close doors on both sides of the hopper car.

U.S. Pat. No. 5,601,032 issued to Kosch on Feb. 11, 1997 entitled APPARATUS FOR OPENING AND CLOSING RAILROAD HOPPER CAR DISCHARGE DOORS is directed to an apparatus for opening and closing the discharge doors of a railroad hopper car comprising a mounting frame secured to the hopper car forward of the discharge door. A pivot arm is secured to the mounting frame and has an air cylinder pivotally secured thereto that is interconnected to the pivot frame. Extension of the hydraulic cylinder causes the pivot frame to pivot with respect to the mounting frame thereby causing the adjustable linkage to open the door. Retraction of the cylinder rod into the cylinder causes the pivot frame to pivot with respect to the mounting frame to cause the adjustable linkage to close the discharge door.

Each of the above efforts to provide a rail car door closer suffers from excessive complexity and/or difficulty of use. It would be desirable to have a rail car door closer that is relatively inexpensive, operationally simple, and safe to use.

SUMMARY OF THE INVENTION

It is therefore an object of the present invention to provide an apparatus for closing rail car doors, such that multiple car doors could be closed at one time. It is a further object of the present invention to provide an apparatus for rail car door closure that is safe for workers and eliminates the need for manual door closure. Still another object of the present invention is to provide a rail car door closure apparatus that is of simple construction and operation, which achieves the stated objectives in an effective and relatively inexpensive manner, that solves the problems and satisfies the needs existing in the art.

In fulfillment of these and other objectives, the present invention provides a device that includes a rail car door closer system wherein the lifting of a plurality of appropriately positioned door closer arms is accomplished with hydraulic cylinders, pneumatic cylinders or electric motors. In using hydraulic or pneumatic cylinders, connections to the closer arms can be made with interconnected push-pull rods with swivel ball joints and/or clevis yokes that allow for an extreme arch of movement for the closing arms.

The closing arms are configured in shapes adapted to various styles of hopper doors. The closing arm assemblies may be added in pairs depending on the quantity of doors on a particular type of rail car. For example, the typical aggregate car will need six doors; a typical coal car, ten doors. The car door closer system will close half of the doors in one motion and the second half of the doors (facing the opposite direction) in the next motion. This ability makes the unit ideal for automation or semi-automation.

The swing doors on typical bottom discharge hopper car require that one door be closed before the other in order for the door latching mechanism to lock. A hopper car is often connected to other cars in such a manner that the first closing door might be forward and the next car might have the first closing door rearward. The door closer of the present invention can be sequenced to adapt to this situation, hence the first motion of the first set of closing arms can be for either forward facing doors or rearward facing doors.

The main frame of the closer assembly is a rectangular steel bar approximately 6" high by 2" wide. The bar extends beyond the unloading pit for securing at both ends. Cross members may also be added for support. The closer arms that are positioned on the main frame may be cut from ¾" flat plate steel and are each fitted with a welded boss to distance the closer arm from the main frame and to support closer arm rotation. Hydraulic cylinders may be used to actuate the closer arm assemblies. A differential bell crank can be used to actuate the closer arm assemblies to take advantage of a shorter stroke cylinder.

The closer arms may be mounted staggered from side-to-side on the main frame of the track or all on one side of the track. The closer arm push-pull rod lengths are adjusted to accommodate the positioning of the closer arms. Swivel ball or clevis yoke connections with in-board and out-board mounting on the closer arms are used to allow for clearance of the push-pull rods.

Slack adjusting mechanisms are also described in alternative embodiments that allow for small variations in the lateral spacing of the hopper gate doors on a railcar. Closer arm pivot points may be common (centered) or separate (offset from center) in a closer arm assembly. Finally, an alternate embodiment using individual hydraulic cylinders for each closer arm is also described, replacing the push/pull rod with hydraulic lines and cylinders.

BRIEF DESCRIPTION OF THE DRAWINGS

A better understanding of the rail car door closer of the present invention may be had by reference to the drawing figures wherein.

DETAILED DESCRIPTION OF THE PREFERRED EMBODIMENT

Figure 1:
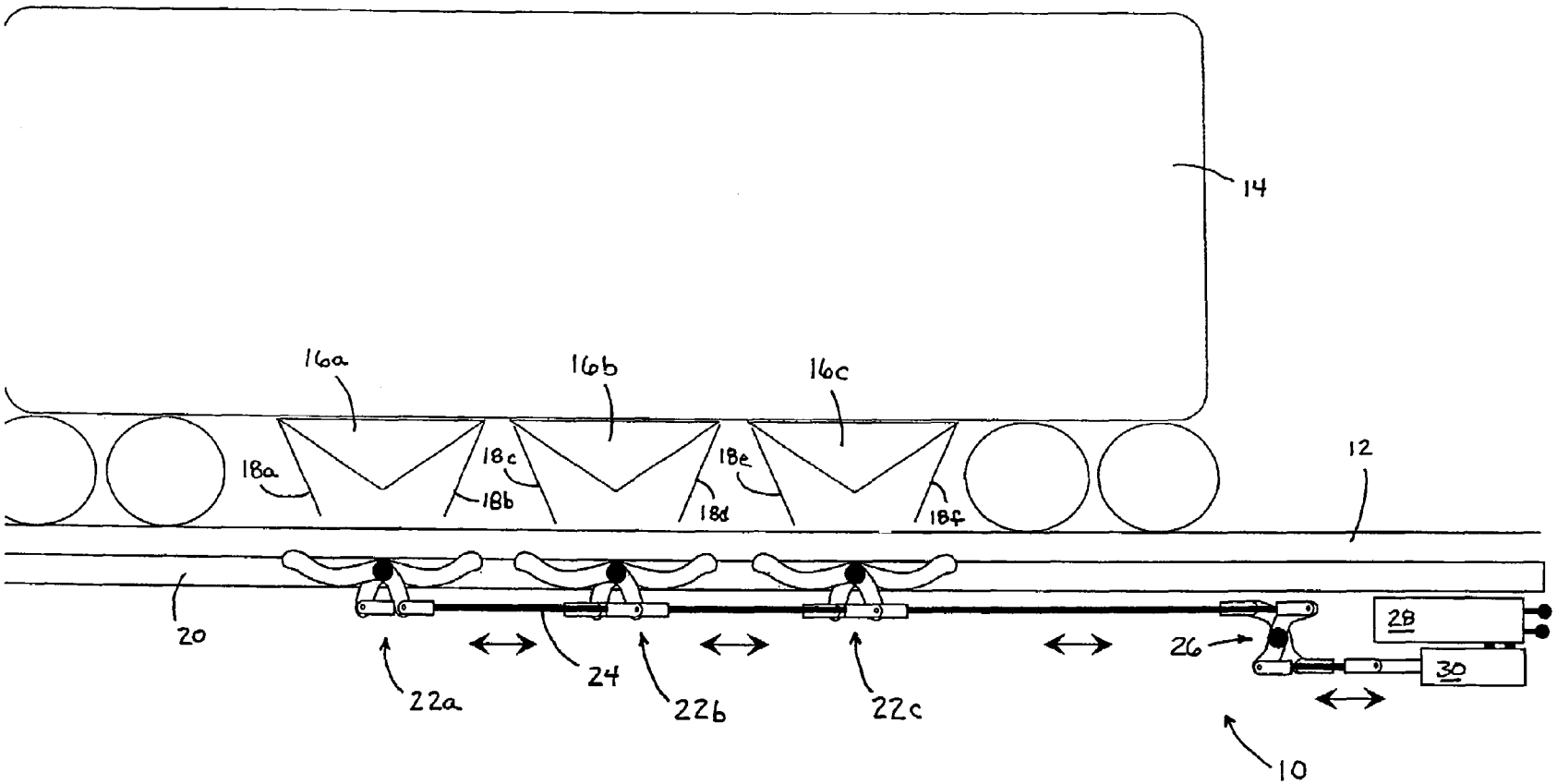
FIG. 1 is an overview of the system of the rail car and the car door closer mechanism of the present invention.

An overview of the various assemblies that together make up the rail car door closer system 10 of the present invention is shown in FIG. 1, wherein the rail car 14 is positioned on the rails 12 of a track with the hopper doors 18*a* & 18*b*, 18*c* & 18*d*, and 18*e* & 18*f* of hoppers 16*a*, 16*b* & 16*c*, open above the closer arm assemblies 22*a*, 22*b* & 22*c*. The closer arm assemblies 22*a*, 22*b* & 22*c* are pivotally positioned on main frame 20 and are connected in series by push-pull rods 24 to a bell crank assembly 26. The bell crank assembly 26 is connected to hydraulic cylinders 30 (one of which is shown) which are operably connected to hydraulic controls 28. Two push-pull rod linkage assemblies 24 are present, one positioned behind the other in the view of FIG. 1, the first associated with a first, left-hand set of closer arms and the second with a second, right-hand set of closer arms. Operation of the hydraulic cylinders 30 by way of lever actuated valves (as is known in the art) causes appropriate motion of the respective hydraulic cylinders 30 to rotate the appropriate bell crank assembly 26 components and alternately actuate the first or the second push-pull rod linkage assemblies 24. Movement of the first push-pull rod linkage assembly 24 causes the first set of (left-hand) closer arms to move against the left-hand hopper doors 18*a*, 18*c* & 18*e* and close them. These are held in place while the second push-pull linkage assembly (not visible) is actuated by a second hydraulic cylinder (not visible) and causes the second set (right-hand) of closer arms to move against the right-hand hopper doors 18*b*, 18*d* & 18*f* and close them over the first so as to latch the doors as is typical upon such closure.

Figure 2:
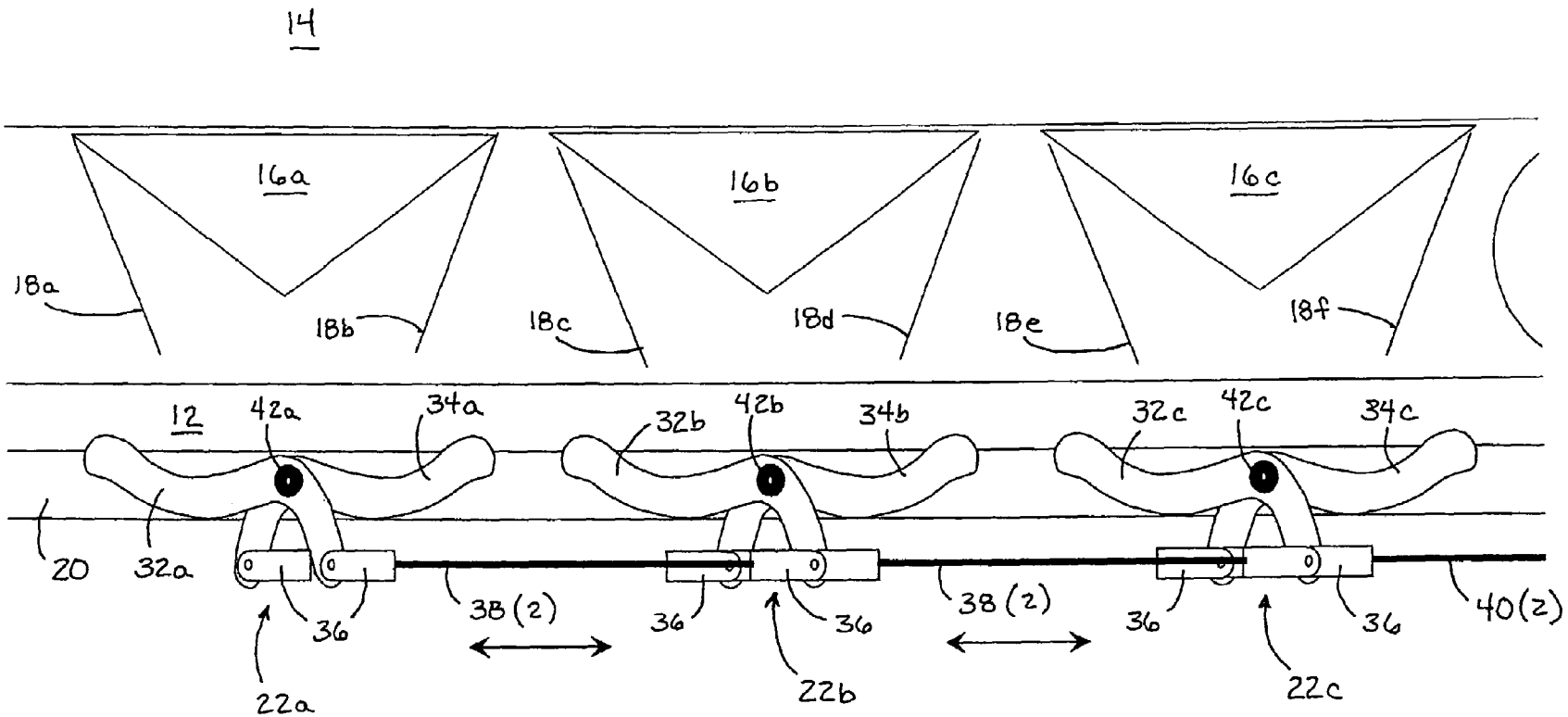
FIG. 2 is a detailed view of the rail car door closer assemblies.

FIG. 2 illustrates a detailed view of the rail car door closer assemblies 22*a*, 22*b* & 22*c*. The left-most members 32*a*, 32*b* & 32*c* of the closer arm assemblies 22*a*, 22*b* & 22*c* are operably connected together by a first push-pull rod linkage 38. The right-most members 34*a*, 34*b* & 34*c* of the closer arm assemblies 22*a*, 22*b* & 22*c* are operably connected together by a second push-pull rod linkage 38 (partially hidden behind the first push-pull rod linkage in this view). Clevis attachment devices 36 pivotally connect the push-pull rods to the closer arm assemblies.

Figure 3:
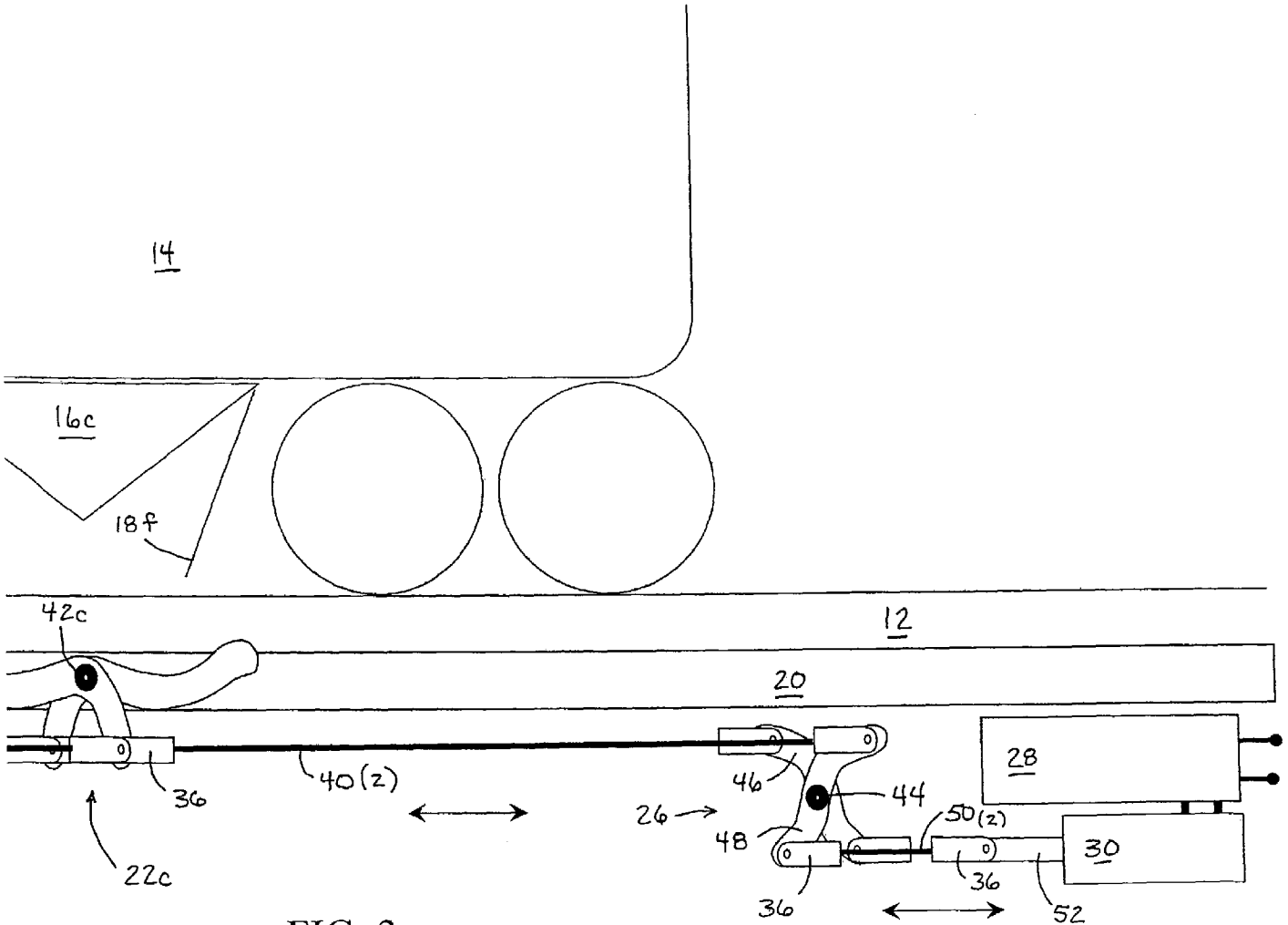
FIG. 3 is a detailed view of the bell crank and hydraulic cylinder assemblies.

FIG. 3 is a detailed view of the bell crank 26 and hydraulic cylinder 30 assemblies wherein the closer arm assemblies (22*c* shown) are connected to the bell crank 26 through the push-pull rod linkage 40. The bell cranks 26 (two in the preferred embodiment) are connected to the shafts 52 of hydraulic cylinders 30 (two in the preferred embodiment) and enable the use of a shorter stroke cylinder for the linear actuated motion of the hydraulic cylinders. Operation of the two hydraulic cylinders 30 is by means of hydraulic pumps and valves contained within hydraulic controls 28 as is well known in the art. It is anticipated that a single lever mechanism may be configured to serve as the actuating lever for both the first and second push-pull rod linkages and therefore the alternate operation of the first (left) and then the second (right) side sets of closer arms.

Figure 4A:
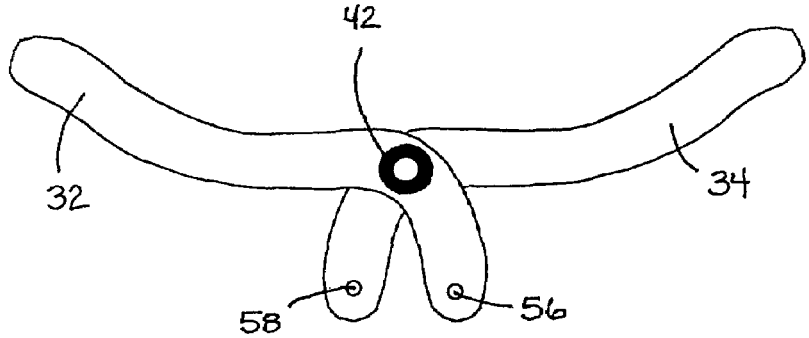
FIGS. 4A-4C are detailed views of the closer arm arrangement options.
Figure 4B:
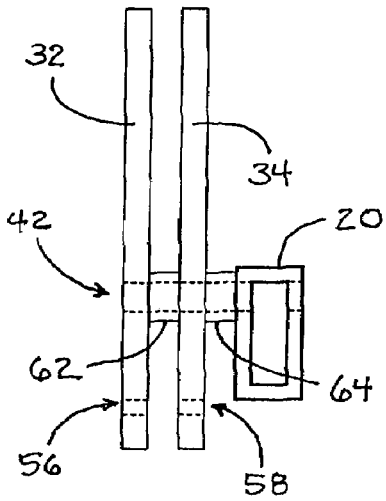
Figure 4C:
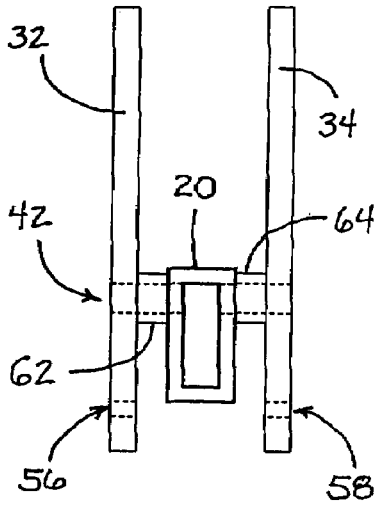

Each of the closer arm mechanisms 22*a*, 22*b* & 22*c* are shown by example in FIGS. 4A-4C in the alternative as either both arms 32 & 34 mounted to one side of the main frame 20 (FIG. 4B) or with one on either side of the main frame 20 (FIG. 4C). The closer arm mounting bolt holes 42 are preferably slotted to allow for adjustment between centers of a pair of closer arms 32 & 34 to further increase the flexibility of adapting to different types of hopper doors. Clevis bolt holes 56 & 58 are shown positioned on one end of each closer arm 32 & 34 for connection to the push-pull rod linkage assemblies. Welded bosses 62 & 64 are shown to position and space apart the closer arms 32 & 34.

Figure 5A:
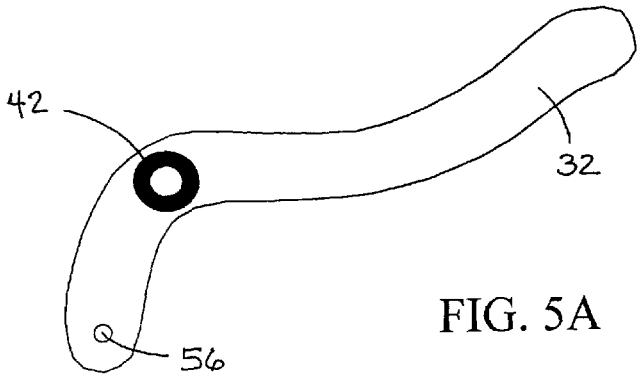
FIGS. 5A-5E are detailed views of the rail car door closer arms and frame attachment structures of the present invention.
Figure 5C:
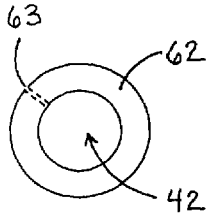
Figure 5D:
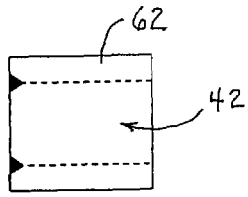
Figure 5B:
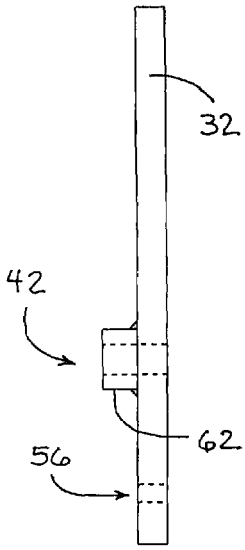
Figure 5E:
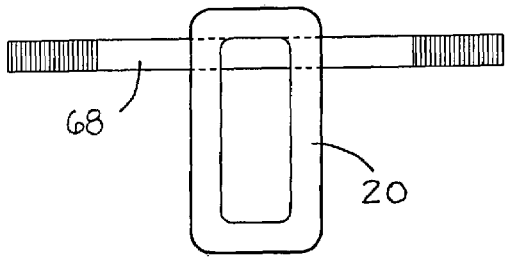
Figure 6A:
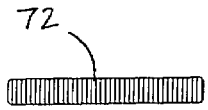
FIGS. 6A-6B are detailed views of the push-pull rod attachment structures.
Figure 6B:
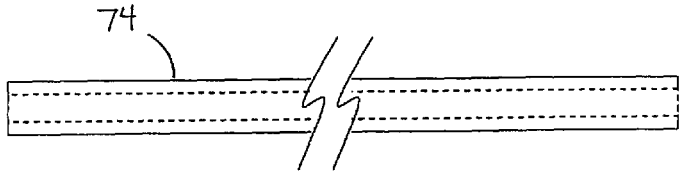

Continuing in FIGS. 5A-5E, the main frame structure 20 is illustrated as well as the details of the closer arm structure 32 with the clevis mounting hole 56 and the welded boss 62 for the pivot point 42 on the closer arm 32. 1" by 2" tubing 74 cut to length is shown in FIGS. 6A & 6B for connection of the push-pull rods to the closer arms via 1" threaded bolts 72 which are cut to length and welded to the push-pull rods. As shown in FIG. 5E 1¼" bolts 68 may be used to fasten the closer arms to the main frame 20. A grease fitting 63 may be installed at the boss 62 to provide lubricant for rotation of the closer arm. A pair of 5" bore by 18" stroke hydraulic cylinders may be used to activate the closer arm assemblies although alternative actuating mechanisms as will be apparent to those skilled in the art.

Figure 7A:
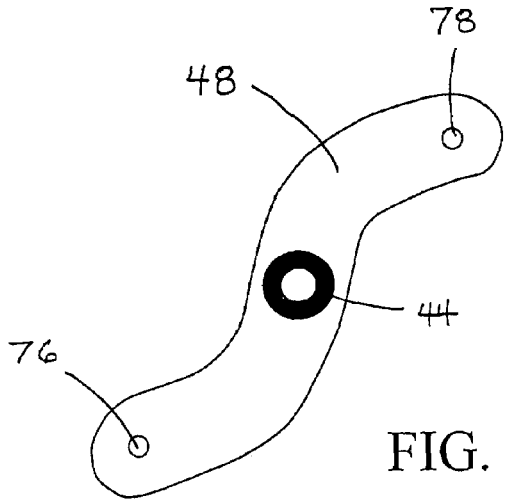
FIGS. 7A-7B are detailed views of the bell crank structures.
Figure 7B:
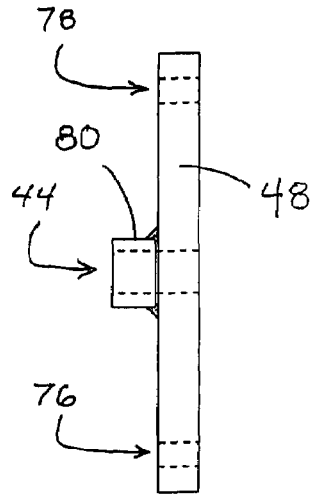
Figure 8:
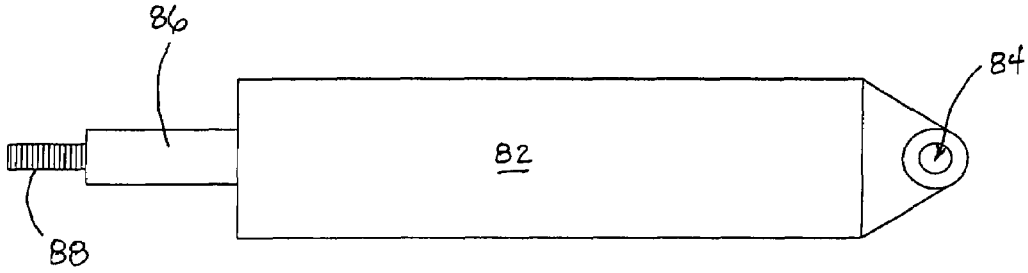
FIG. 8 is a detailed view of the hydraulic cylinder structure.

The detail of bell crank assembly 26 is illustrated in FIGS. 7A & 7B. Clevis mounts are used to attach a first end 76 of each of the bell cranks 48 & 46 to each of the hydraulic cylinders and a second end 78 to the respective push-pull rods. Also shown in FIG. 7B is the welded boss 80 for the bell crank 48 which is essentially the same as that for the closer arm. FIG. 8 illustrates the hydraulic cylinder 82 having a 1" hole 84 for attachment to the clevis mount (not shown).

Figure 9A:
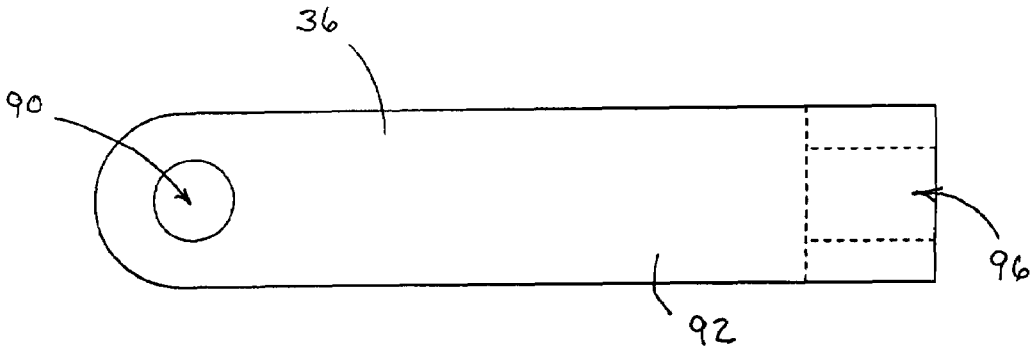
FIGS. 9A-9B are detailed views of the clevis mount structure.
Figure 9B:
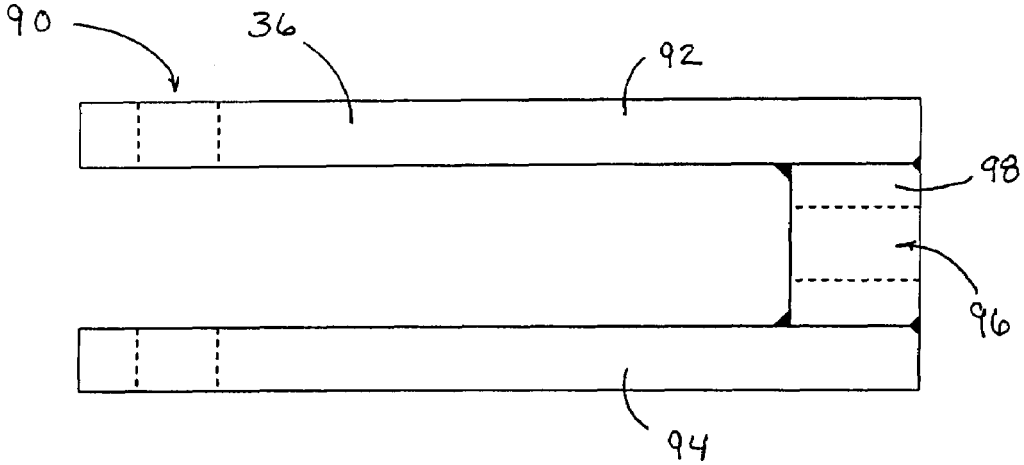

FIGS. 9A-9B illustrate the details of the clevis mount connectors 36 which may preferably be manufactured from ½" by 2" flat strap (92 & 94) and one and a quarter square stock (98). One end of the clevis mount connector 36 has a 1" threaded hole 96 with a 1" back-up nut (not shown), while the other end has an orthogonally directed 1" diameter hole 90. The clevis mount connector 36 is used to connect the closer arm assemblies 22*a*, 22*b* & 22*c* and the bell crank assembly 26 to the push-pull rod assemblies 38 & 40.

DETAILED DESCRIPTION OF AN ALTERNATE PREFERRED EMBODIMENT

Figure 10:
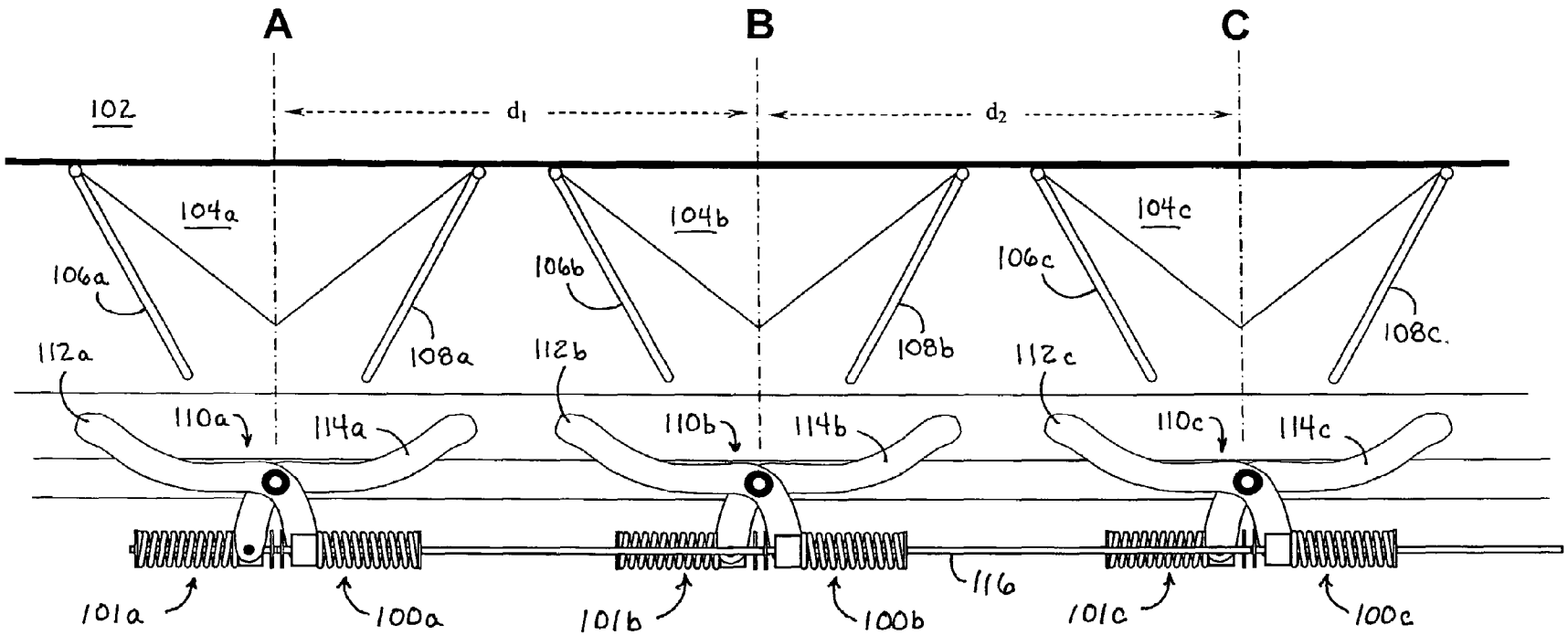
FIG. 10 is an overview of an alternate embodiment of the system the rail car door closer mechanism of the present invention.

Some hopper rail cars can have small center-to-center dimensional differences between hopper discharge gates. As indicated above, the spacing between the closer arm pairs of the present invention is primarily determined by the center-to-center spacing of the hopper discharge gates. Therefore, small differences in the distances between the hopper discharge gates can cause minor alignment problems that ultimately could result in the incomplete closure of one of the two hopper discharge gate doors in a set despite the complete closure of the matching door associated with that particular gate. It would therefore be beneficial to have a mechanism capable of automatically compensating for these small differences in the center-to-center dimension without putting undue stress or pressure on any given hopper door in order to secure its complete closure. For example, if the left hand doors associated with gates A and B as shown in FIG. 10 were in a closed position, the left hand door associated with gate C might require a small (<1") additional movement of the push/pull rod to close completely. FIG. 10 discloses in general a mechanism suitable for allowing these minor dimensional differences to occur without jeopardizing the ability of this system to completely close each of the hopper doors. In summary, such a system would include a swivel block that may be attached to the closer arm and slide some distance along the push/pull rod in either direction. A welded washer on the push/pull rod would serve as a base for a compression spring, also centered around the push/pull rod. The compression spring would normally be relaxed but in contact with the swivel block. A retraction washer would also be welded to the push/pull rod on the opposite side of the spring and block and thereby restrict movement of the swivel block in the opposite direction.

In practice, the doors associated with gates A and B would be closed and the door associated with gate C might require ⅜" more travel (for example). The compression spring would begin to collapse at gates A and B limiting closing pressure, but push/pull rod could continue to move through the swivel blocks at the closer arms for gates A and B and close the door associated with gate C. When push/pull rod is retracted to lower the closer arms, the welded stop washer on the push/pull rod opposite of the spring side will make contact with the swivel block and lower the closer arm.

Any compression device such as a spring or a gas filled shock would allow extended movement of the push/pull rod to adapt to dimensional differences between the hopper doors. Compression devices may also be installed on both sides of the swivel block for each closer arm in a manner that will keep the closer arm captive at all times during the raise and lower cycle.

Reference is again made to FIG. 10 for a general description of the alternate preferred embodiment of the present invention incorporating the slack adjustment mechanisms generally described above. Rail car 102 in FIG. 10 incorporates hopper discharge gates 104*a*, 104*b* and 104*c*. The system of the present invention typically operates against the pairs of hopper discharge gate doors in sets of three as described above. In FIG. 10 this would mean that the system operates against hopper discharge gate doors 106*a*, 106*b* and 106*c* at the same time and then against hopper discharge gate doors 108*a*, 108*b*, and 108*c* together at the same time. The operation of the closer arm pairs 110*a*, 110*b*, and 110*c* in this alternate embodiment is essentially the same as the operation of the same in the system described above in the first preferred embodiment.

The first set of closer arms 112*a*, 112*b* and 112*c* are manipulated by the system to close the first set of hopper discharge gate doors and the second set of closer arms 114*a*, 114*b* and 114*c* subsequently operate to close the remaining set of hopper discharge gate doors. The unique features of the alternate embodiment described herein relate to the automatic slack remover assemblies 100*a*, 100*b* and 100*c*, as well as 101*a*, 101*b* and 101*c* shown in place on push/pull rods 116 in FIG. 10. Each of these slack remover assemblies essentially take the place of the clevis attachment devices 36 described above in the first preferred embodiment. Orientation of the slack remover devices, however, depends upon which of the push/pull rods 116 are being implemented in conjunction with which of the two sets of closer arms, again as described above.

Repeating the anticipated circumstances described above, it is possible that the closure of hopper discharge gate doors 106*a* and 106*b* by closer arms 112*a* and 112*b* might be accomplished without the complete closure of hopper discharge gate door 106*c* by closer arm 112*c*. In order to fully close hopper discharge gate door 106*c* it may be necessary for push/pull rod 116 to continue further than might normally be possible as limited by the full closure of hopper discharge gate doors 106*a* and 106*b*. In order to accomplish this, push/pull rod 116 must be able to continue past the stop point encountered with the closure of hopper discharge gate doors 106*a* and 106*b* and does so by means of the spring loaded mechanisms in slack remover assembly 100*a* and 100*b*. The pressure or force that push/pull rod 116 continues to exert is absorbed by the compression mechanism (the spring) in these systems and is not therefore exerted as a stress inducing force on the hopper doors themselves.

Figure 11:
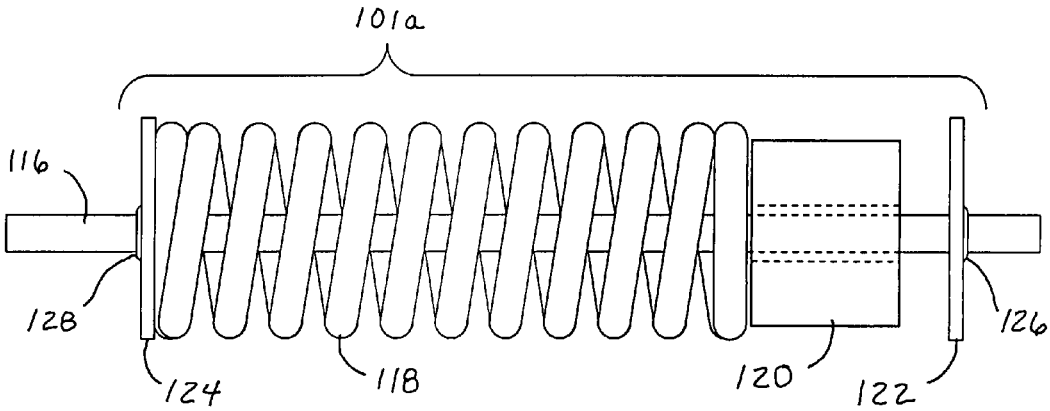
FIG. 11 is a detailed view of a compression spring assembly in the alternate embodiment of the present invention shown generally in FIG. 10.

Referencing FIG. 11, greater detail on the components of slack remover assembly 101*a* is disclosed. In FIG. 11, automatic slack remover 101*a* includes compression spring 118 and swivel block 120. Each of spring 118 and swivel block 120 are centered on and are capable of sliding along push/pull rod 116. Restricting the sliding movement on push/pull rod 116 are washers 122 and 124 which are fixed to push/pull rod 116 with welds 126 and 128, respectively. The view shown in FIG. 11 is that of automatic slack remover assembly 101*a* (which is identical to the assembly of 101*b* and 101*c*) and which is a mirror image of the slack remover assemblies 100*a*, 100*b* and 100*c*. Once again, the orientation and placement of spring 118 and swivel block 120 is dependent upon whether the closer arm is rotated on a push or a pull of push/pull rod 116.

Figure 12A:
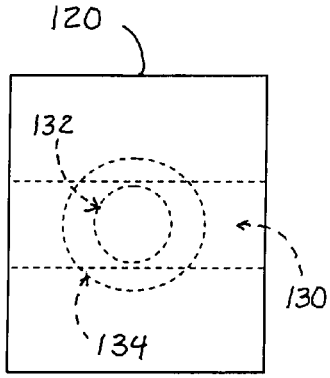
FIGS. 12A & 12B are detailed views of the swivel block in the alternate embodiment of the present invention shown generally in FIG. 10.
Figure 12B:
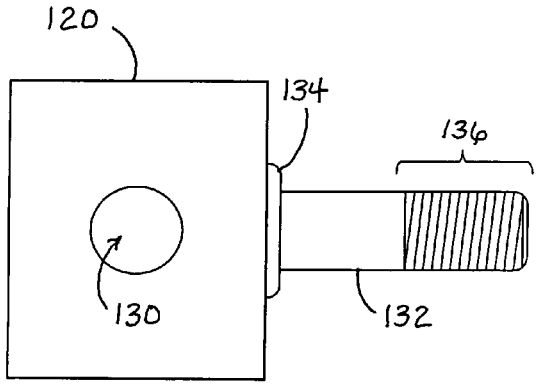

Referencing FIGS. 12A and 12B, the details of swivel block 120 can be seen. The view shown in FIG. 12A is the same view shown of the block in FIGS. 10 and 11 but disclose in dashed line detail aperture 130 that extends through swivel block 120 to allow the passage of push/pull rod 116. The interior dashed line circle indicates the attachment shaft 132 welded to swivel block 120 with weld 134. Attachment shaft 132 is seen in a better view in FIG. 12B. Threaded section 136 of attachment shaft 132 is configured to receive a threaded nut for attachment of swivel block 122 to the respective closer arm assembly as shown in FIG. 10. In this manner each closer arm is free to rotate on the associated swivel block as the push/pull rod moves the swivel block to direct the closer arm to close the hopper door.

Some slack may be anticipated in the assembly mechanism described without detrimental effects on the operation of the system. Opposing washers 122 and 124 confine both the compression spring 118 and swivel block 120 within a given lateral distance along push/pull rod 116 sufficient to accommodate the necessary motion of the closer arms and to absorb appropriate forces associated with taking up the additional slack as may be required resulting from irregular variations in the distance between the hopper doors themselves. Typically this distance is no more than a few inches and can be easily accommodated by available coil springs or hydraulic cylinder shocks.

Figure 13:
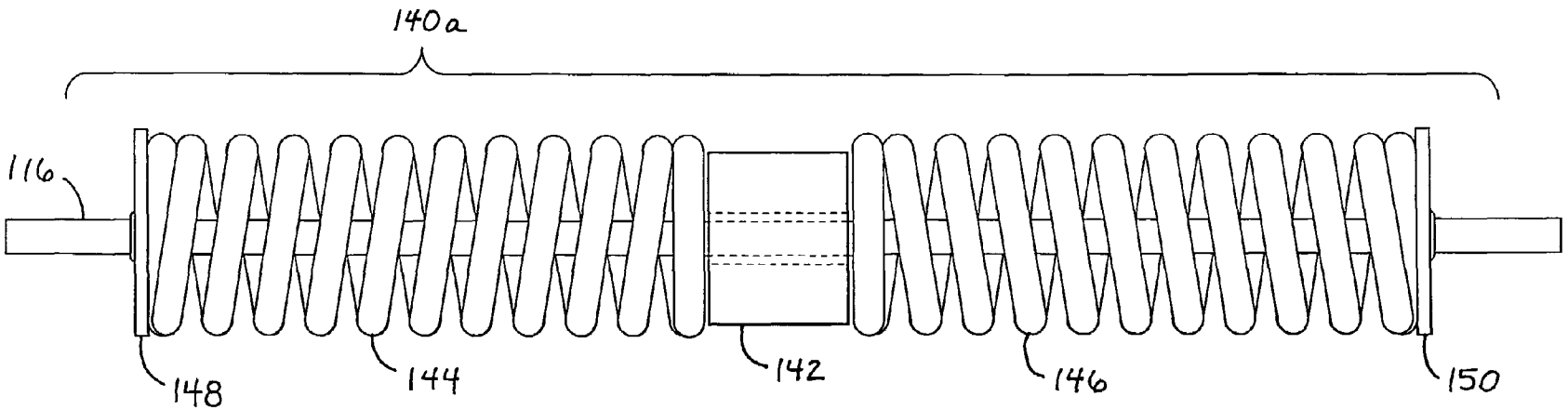
FIG. 13 is a detailed view of a dual compression spring assembly in a further alternate embodiment of the present invention.

A further alternative embodiment of the invention is shown in FIG. 13 wherein the single compression spring described above is replaced with two opposing springs 144 and 146 positioned on either side of swivel block 142. This slack remover assembly 140*a* is universally applicable to whichever direction push/pull rod 116 may be required to move in order to activate the closer arm associated with the assembly. In this case, welded washers 148 and 150, position springs 144 and 146 on either side of swivel block 142 and allow the movement of swivel block 142 against the compressive force of either spring depending upon the lateral motion of push/pull rod 116. Although the above alternate preferred embodiments have been described primarily in conjunction with the use of compression springs, similar resilient compression devices may be used in place thereof. Hydraulic cylinder arrangements may be used in place of the compression spring to accomplish the same function.

Figure 14:
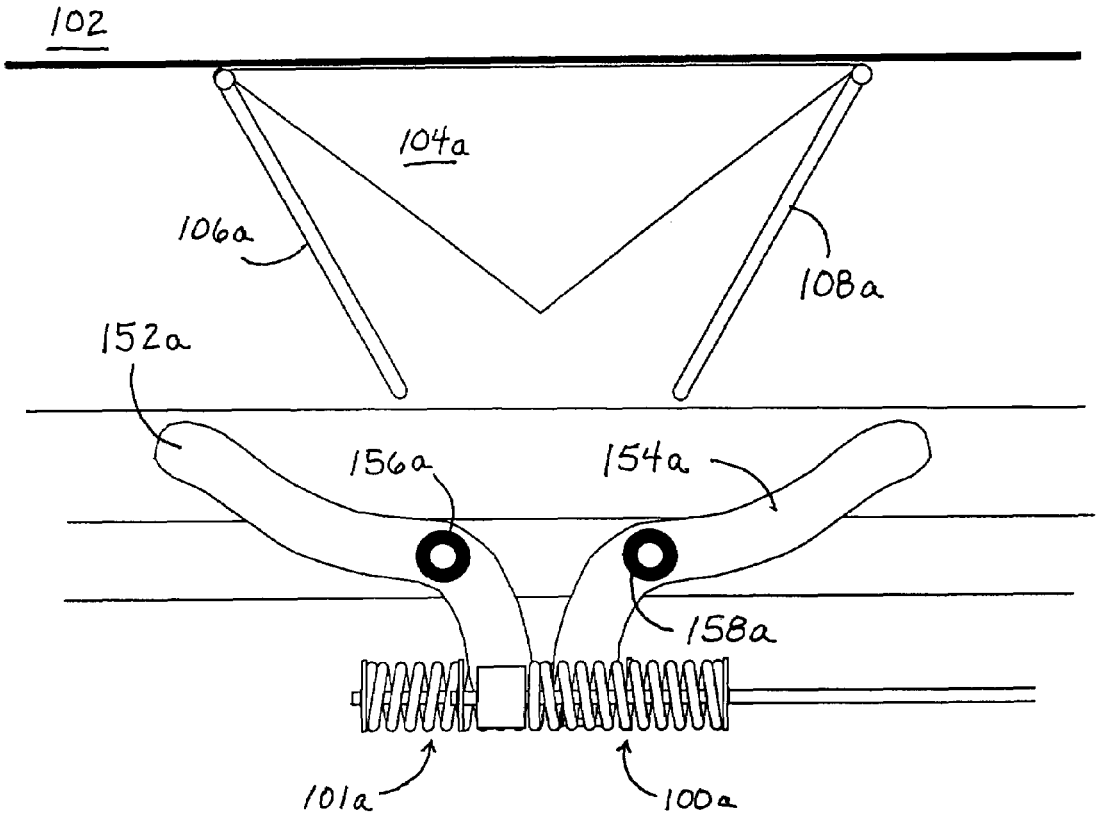
FIG. 14 is a side detail view of an alternate placement of the pivot points for the closer arms in an alternate embodiment of the present invention.

FIG. 14 discloses a modification of the basic embodiments of the present invention, in which the previously common and centered pivot point for a set of closer arms has been separated into two pivot points offset from a centerline of the closer arm assembly. In this embodiment, closer arms 152*a* and 154*a* each pivot on their own separate pivot points 156*a* and 158*a*, respectively. This approach allows for a reduction in the size of each closer arm and further provides greater tolerance for off-center placement of the rail car.

Figure 15:
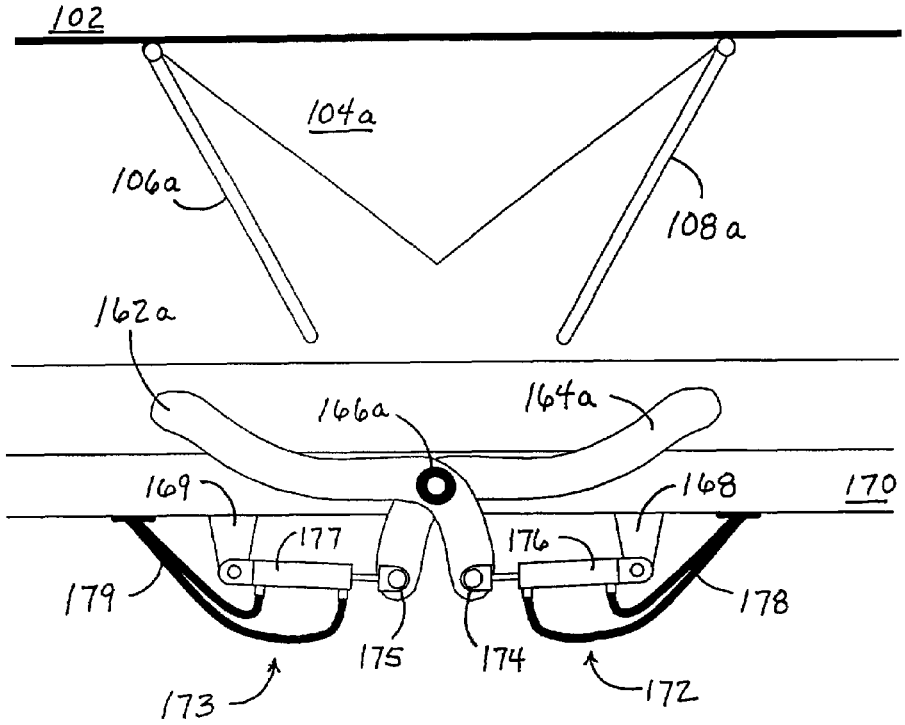
FIG. 15 is a side detail view of a representative closer arm assembly in a further alternate embodiment of the present invention, utilizing individual hydraulic cylinders on each closer arm.
Figure 16:
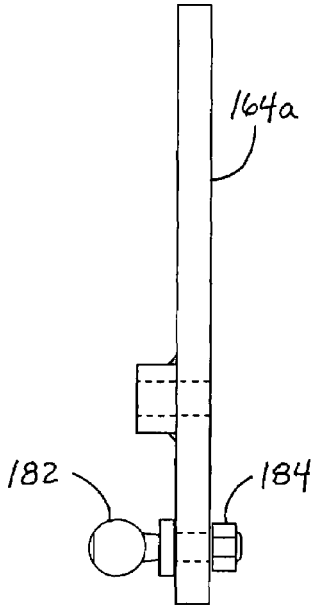
FIG. 16 is a detailed view of a closer arm in the alternate embodiment of the present invention shown generally in FIG. 15.
Figure 17:
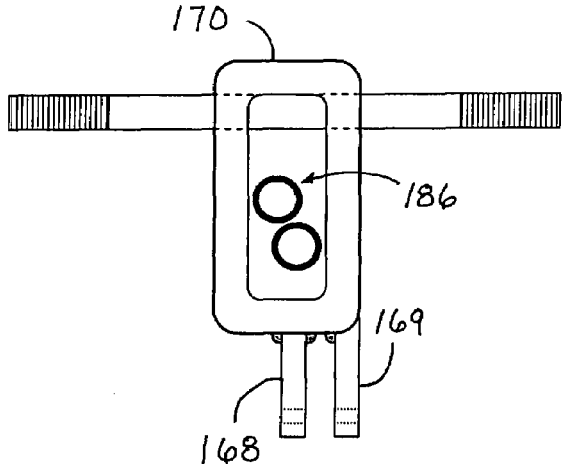
FIG. 17 is a detailed cross sectional view of the main frame support assembly in the alternate embodiment of the present invention shown generally in FIG. 15.

FIGS. 15-17 provides details of yet a further alternate embodiment of the present invention wherein individual hydraulic cylinders have replaced the push/pull rod and closer arm connection assemblies of the above described embodiments. In FIG. 15 a representative closer arm assembly comprising closer arms 162*a* and 164*a* is shown to pivot on common pivot point 166*a*. In this embodiment, however, main frame strut 170 also provides support for brackets 168 and 169 which in turn support hydraulic closer assemblies 172 and 173.

Hydraulic closer assembly 172 includes hydraulic cylinder 176, ball joint socket 174, and hydraulic hoses 178. In similar fashion hydraulic closer assembly 173 includes hydraulic cylinder 177, ball joint socket 175, and hydraulic hoses 179. The attachment of each hydraulic cylinder to the respective closer arm is accomplished by way a standard ball hitch type connection as described in more detail below. Although closer assembly 173 is shown in FIG. 15 as being oriented opposite that of closer assembly 172, it is understood that with proper placement of bracket 169 and the associated hardware, closer assembly 173 could be oriented in parallel next to closer assembly 172.

FIG. 16 shows in detail the configuration of closer arm 164*a* (as an example) as implemented in the alternate embodiment shown in FIG. 15. Ball connector 182 is bolted to closer arm 164*a* through the aperture in the lower end thereof where it is secured with nut 184. The second closer arm in the pair is configured in a similar manner allowing for proper spacing and alignment to avoid contact between the ball joint connections. FIG. 17 provides an example of a manner of positioning brackets 168 and 169 on to main frame strut 170. Again, spacing and alignment of these brackets provides appropriate spacing and alignment of the respective ball connection joints. Also shown in FIG. 17 (a cross-sectional view) is the placement of hydraulic supply lines 186 within the rectangular conduit structure of the main frame strut 170. Such hydraulic supply lines may be fitted with appropriate couplings to distribute the hydraulic fluid through feeder lines (178 and 179 in FIG. 15, for example) to the hydraulic closer assemblies. Hydraulic feeder lines may exit the protective enclosure of the main frame strut 170 at apertures (not shown) provided with appropriate grommets to prevent abrasion on the lines.

The system has been disclosed herein by reference to its preferred embodiment and a number of alternate embodiments. It is anticipated that those skilled in the art will recognize further modifications and extensions of the present invention described above that fall within the scope of the invention.

I claim:

1. A system for simultaneously closing multiple hopper doors on a rail car, the system positioned in fixed association with a section of track on to which the rail car may be moved, the system comprising:

a plurality of closer arm assemblies positioned in fixed association with at least one rail of the section of track and rotationally operable to make contact with and close the hopper doors when the rail car is positioned on the section of track, the plurality of closer arm assemblies each comprising left hand and right hand opposing closer arms;

a linkage assembly connecting the closer arm assemblies together and linearly operable to direct the rotational movement of the closer arm assemblies in concert, the linkage assembly comprises a plurality of rigid rods extending between automatic compressible slack adjusting end connectors, the automatic compressible slack adjusting end connectors pivotally connected to the closer arm assemblies;

a bell crank assembly connected to the linkage assembly and rotationally operable to direct the linear movement of the linkage assembly; and a linear actuator connected to the bell crank assembly and linearly operable to direct the rotational movement of the bell crank assembly.

2. The system of claim 1 wherein the linkage assembly comprises a first set of push-pull rods connecting together the left hand closer arms of each of the closer arm assemblies and a second set of push-pull rods connecting together the right hand closer arms of each of the closer arm assemblies.

3. The system of claim 2 wherein the bell crank assembly comprises a left hand bell crank connected to the first set of push-pull rods of the linkage assembly and a right hand bell crank connected to the second set of push-pull rods of the linkage assembly.

4. The system of claim 1 wherein the linear actuator comprises a hydraulic cylinder.

5. The system of claim 1 wherein the linear actuator comprises a pneumatic cylinder.

6. The system of claim 1 wherein the linear actuator comprises an electric motor having a screw-drive gear assembly.

7. The system of claim 1 wherein the automatic compressible slack adjusting end connectors each comprise:

first and second stop washers fixed in spaced relationship on an end of one of the plurality of rigid rods;

a compression spring positioned coaxially on the rigid rod between the first and second stop washers; and a sliding swivel block positioned on the rigid rod between the compression spring and one of the stop washers;

wherein the swivel block is pivotally attached to a closer arm.

8. The system of claim 1 wherein the automatic compressible slack adjusting end connectors each comprise:

first and second stop washers fixed in spaced relationship on an end of one of the plurality of rigid rods;

first and second compression springs positioned coaxially on the rigid rod between the first and second stop washers; and a sliding swivel block positioned on the rigid rod between the first and second compression springs;

wherein the swivel block is pivotally attached to a closer arm.

9. The system of claim 1 further comprising a frame beam extending parallel to and adjacent the track, the frame beam comprising a longitudinal beam with a plurality of pivot bolts extending orthogonal thereto, the pivot bolts serving as attachment points and as pivot points for the rotational operation of the closer arm assemblies.

10. The system of claim 2 wherein the rail car hopper doors are arranged in opposing pairs and the left hand closer arms operate in concert to simultaneously close the hopper doors oriented in a first direction and the right hand closer arms operate in concert to simultaneously close the hopper doors oriented in a direction opposing the first direction.

11. A system for simultaneously closing multiple hopper doors on a rail car positioned on a track, the system comprising:

a plurality of closer arm assemblies positioned adjacent the track and rotationally operable to make contact with and close the hopper doors, the plurality of closer arm assemblies each comprising left hand and right hand opposing closer arms, the opposing closer arms each rotatable about a separate off-set pivot, the closer arms each having a free end moveable in a large arc so as to contact and close the hopper doors associated therewith, the closer arms each further having a linkage end distal from the respective free end thereof, the linkage ends of the closer arms moveable in a small arc and pivotally connected to the linkage assembly;

a linkage assembly connecting the closer arm assemblies together and linearly operable to direct the rotational movement of the closer arm assemblies in concert;

a bell crank assembly connected to the linkage assembly and rotationally operable to direct the linear movement of the linkage assembly; and a linear actuator connected to the bell crank assembly and linearly operable to direct the rotational movement of the bell crank assembly.

* * * * *